United States Patent [19]

Lobato

[11] Patent Number: 4,634,288

[45] Date of Patent: Jan. 6, 1987

[54] AUXILIARY TIMING SOURCE FOR AC-POWERED ELECTRONIC CLOCKS

[75] Inventor: Toribio Lobato, San Dimas, Calif.

[73] Assignee: Clemar Manufacturing Corporation, Glendora, Calif.

[21] Appl. No.: 724,095

[22] Filed: Apr. 17, 1985

[51] Int. Cl.[4] ..... G04B 17/12

[52] U.S. Cl. ..... 368/200; 368/203; 368/155

[58] Field of Search ..... 368/204, 203, 155, 168, 368/200, 202; 307/106, 107

[56] References Cited

U.S. PATENT DOCUMENTS

| | | | |
|---|---|---|---|
| 4,068,465 | 1/1978 | Bacon | 368/82 |
| 4,145,617 | 3/1979 | Lee et al. | 368/204 |
| 4,335,847 | 6/1982 | Levine | 340/309.18 |
| 4,407,019 | 9/1983 | Futami et al. | 368/200 |
| 4,469,274 | 9/1984 | Levine | 340/309.18 |
| 4,531,064 | 7/1985 | Levine | 307/66 |

*Primary Examiner*—Bernard Roskoski

*Attorney, Agent, or Firm*—Kelly, Bauersfeld & Lowry

[57] ABSTRACT

An apparatus and method that provides an auxiliary timing source for electronic clocks, normally powered by alternating current (ac). The apparatus and method includes calibrating an inexpensive resistor-capacitor oscillator, powered by a battery. The oscillator is calibrated during normal ac operation by comparing a digital timing pulse derived from the oscillator and a digital timing pulse derived from the alternating current. When a power failure occurs, the calibrated oscillator provides an inexpensive and accurate auxiliary timing source. The apparatus and method may also include a non-volatile solid-state storage medium for storing the time of day and a set of timing instructions in the event that the battery becomes drained.

14 Claims, 3 Drawing Figures

19
TEMP. ERROR = 0
20
SUBSEC TIMER = 0
22
12
RC TIMING PULSE
24
NO
YES
26
TEMP. ERROR = TEMP. ERROR - 1
60 Hz TIMING PULSE
28
NO
YES
TEMP ERROR = TEMP ERROR + 1
30
SUBSEC TIMER = SUBSEC TIMER + 1
32
SUBSEC TIMER ≥ 60
34
NO
YES
SUBSEC TIMER = 0
36
TIMER ERROR = TEMP. ERROR
38
TEMP. ERROR = 0
40
10
RC OSCILLATOR
250 KHz ± 30%
16
1/4
62.5KHz
18
1/1024
14
61Hz
42
RC TIMING PULSE CALIBRATION
44
TIME BASE
RC TIMING PULSE

AUXILIARY TIMING SOURCE FOR AC-POWERED ELECTRONIC CLOCKS

BACKGROUND OF THE INVENTION

This invention relates generally to electronic clocks powered by an alternating current, and, more particularly, to auxiliary timing sources for these electronic clocks.

Electronic clocks, powered by alternating current (ac), have found widespread application and are embodied in such devices as alarm clocks, pool filter timers and lawn sprinkler and irrigation timers. Typically, the clock's timing source is either the alternating current's 50 or 60 Hz oscillation, which has a timing accuracy of approximately ±0.01%, or an internal crystal oscillator, which has an accuracy on the order of ±0.01 to 0.30%.

During a power failure, an auxiliary timing source is required. Typically, an auxiliary timing source includes a battery, a charger and some associated electronics. For example, the auxiliary timing source for an ac-powered clock might include a battery, a charger and an external oscillator. The external oscillator could be either a crystal oscillator, which is accurate but relatively costly, or a resistor-capacitor (RC) oscillator, which is inexpensive but inaccurate. Because the tolerances of the resistive and capacitive components are rather high, and because of temperature drift and voltage fluctuations, the RC oscillator has a relatively low accuracy, on the order of ±30%. The RC oscillator can be fine-tuned at the factory, but tuning is not an entirely satisfactory solution, since it entails the added cost of the tuning operation and a trimmer circuit. More importantly, the accuracy still cannot be reduced below about ±5%. The crystal-based time source already includes an oscillator, so a battery, and possibly a battery charger, are all that are required. However, as already mentioned, the crystal and its associated electronics are relatively costly.

The battery associated with the auxiliary timing source may also be used to provide the power required to maintain a volatile solid-state storage medium. The time of day and a set of timing instructions are typically stored in the storage medium. With such a configuration, the auxiliary timing source updates the time of day stored in the storage medium. However, when the battery becomes drained, the auxiliary timing source and the volatile storage medium will fail, losing the time of day and timing instructions. Upon restoration of the power, the time of day and the set of timing instructions will typically be reset to predetermined default values or to random values, resulting in erroneous commands to the device being controlled.

Accordingly, there exists a need for an inexpensive and accurate auxiliary timing source for generating the time of day during power failures and a storage medium that will maintain the time of day and the timing instructions in the event that the battery becomes drained.

SUMMARY OF THE INVENTION

The present invention resides in an improved apparatus and method to provide an auxiliary timing source for electronic clocks, normally powered by an alternating current (ac). The improved apparatus and method of the invention includes calibrating an inexpensive resistor-capacitor (RC) oscillator, powered by a battery, and using that calibrated RC oscillator as an auxiliary timing source during a power failure. The improved apparatus and method may also include a non-volatile solid-state storage medium for storing the time of day and a set of timing instructions in the event that the battery becomes drained.

More specifically, the inexpensive RC oscillator is calibrated by constantly computing a timing error between a digital timing pulse derived from the RC oscillator and a digital timing pulse derived from the alternating current. During a power failure, the last computed timing error is used to calibrate the digital timing pulse of the RC oscillator. The calibrated RC oscillator is then used as the auxiliary timing source. In this manner, an accurate, yet inexpensive, battery-operated auxiliary timing source is obtained.

It will be appreciated from the foregoing that the present invention represents a significant improvement in approaches for providing an auxiliary timing source for ac-powered electronic clocks. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

Figure 1:
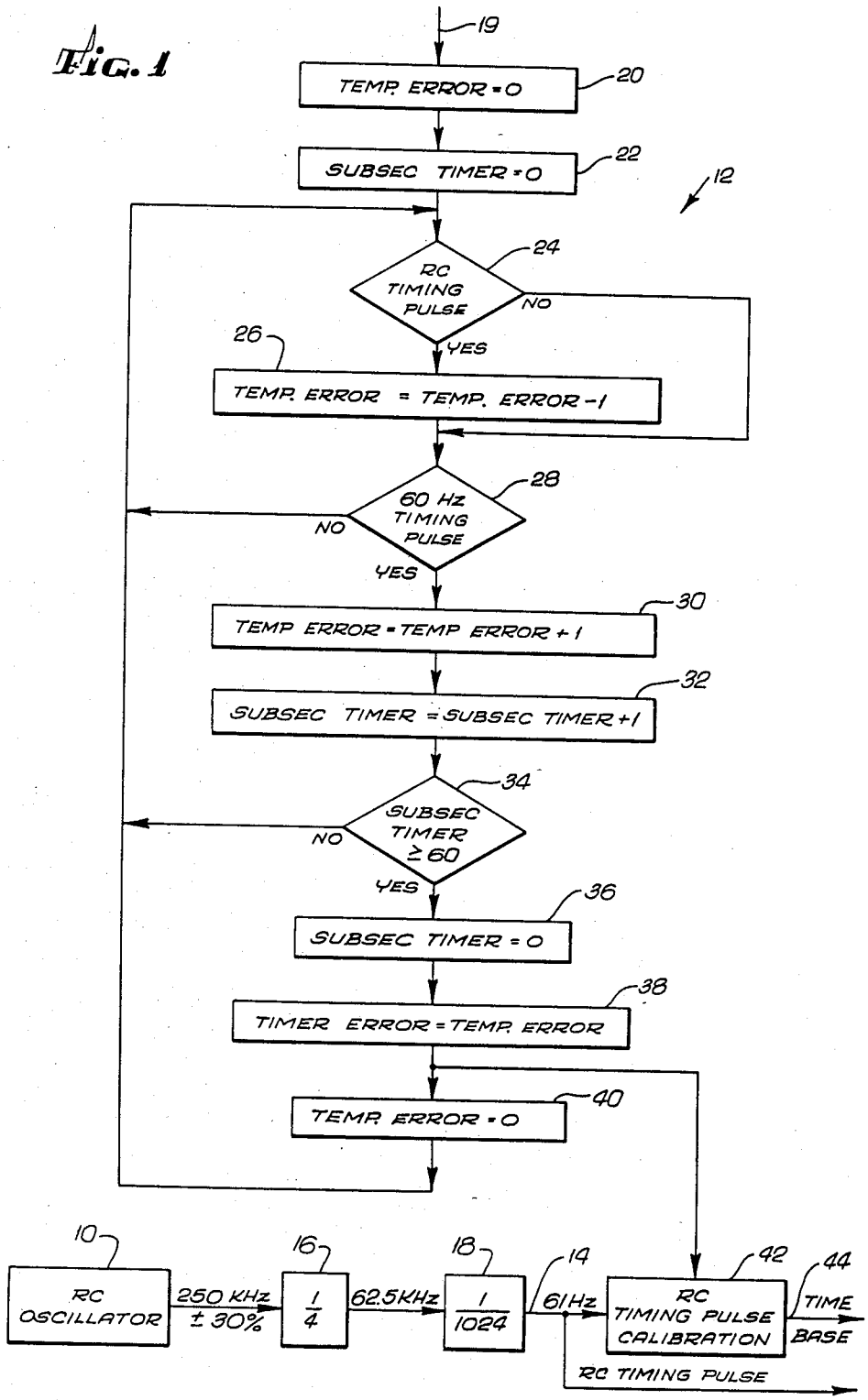
FIG. 1 is a schematic diagram of a calibrated RC timing source and a flow chart of the calibrating instructions.

As shown in the drawings for purposes of illustration, the present invention is embodied in an improved auxiliary timing source for electronic clocks, powered by alternating current (ac). Existing apparatus and methods are either expensive, inaccurate or will not operate when the battery becomes drained.

In accordance with the apparatus and method of the present invention, an inexpensive resistor-capacitor (RC) oscillator, powered by a battery, is calibrated with the alternating current during normal ac operation. The calibrated RC oscillator is used as an auxiliary timing source during power failures. A non-volatile solid-state storage medium may also be used for storing the time of day and a set of timing instructions in the event that the battery becomes drained.

As shown in FIG. 1, a presently preferred embodiment of the invention includes an inexpensive RC oscillator 10 and a set of simple algebraic and logic instructions, represented by a flow chart 12, capable of being implemented in any suitable microprocessor. The RC oscillator 10 includes any resistive and capacitive elements capable of generating a sinusoidal oscillation at a frequency of approximately 250 KHz. The frequency of a typical RC oscillator 10 will have an accuracy on the order of ±30%, allowing for the tolerances of the resistive and capacitive elements, and allowing for temperature drift and voltage fluctuations. The 250 KHz oscillation is converted into a digital RC timing pulse 14, with a frequency of approximately 61 Hz, by a ¼ divider 16 and a 1/1024 divider 18.

In the presently preferred embodiment, the set of algebraic and logic instructions, represented by the flow chart 12 in FIG. 1, is implemented in a COPS 400 microprocessor. The set of instructions generates a timing error between the RC timing pulse 14 and a 60 Hz timing pulse derived from an ac power line, over an approximately one second time period. The timing error is then used to calibrate the RC oscillator 10, during battery operation, to an accuracy of approximately ±2%.

More specifically, as shown by the flow chart 12, a parameter TEMP ERROR counts the difference between the number of RC timing pulses 14 and the number of 60 Hz timing pulses received by the microprocessor, during the approximately one second time period, which is measured by a parameter SUBSEC TIMER. The flow chart 12 is entered at a point 19. The parameter TEMP ERROR is initialized to zero in block 20 and the parameter SUBSEC TIMER is initialized to zero in block 22. A decision block 24 branches the flow chart 12 based on the RC timing pulse 14. If the RC timing pulse 14 has been received by the microprocessor, a block 26 is executed, in which the parameter TEMP ERROR is decremented by one. The flow chart 12 then proceeds to a decision block 28. If the RC timing pulse 14 has not been received, the flow chart 12 branches directly to the decision block 28.

The decision block 28 determines whether the 60 Hz timing pulse has been received by the microprocessor. If it has, block 30 is executed, in which the parameter TEMP ERROR is incremented by one. Then, in block 32, the parameter SUBSEC TIMER is incremented by one. The flow chart 12 then proceeds to another decision block 34. If the 60 Hz timing pulse has not been received, as determined in block 28, the flow chart branches back to the decision block 24.

The decision block 34 determines whether the value of the parameter SUBSEC TIMER is less than sixty or not. If the value of the parameter SUBSEC TIMER is less than sixty, the flow chart branches back to the decision block 24. However, if the value of the parameter SUBSEC TIMER is equal to or greater than sixty, the approximately one-second time period for measuring the timing error has been met. The parameter SUBSEC TIMER is then set to zero in block 36, the value of the parameter TEMP ERROR is assigned to the parameter TIMER ERROR in block 38, and the parameter TEMP ERROR is set to zero in block 40. The flow chart 12 then returns to the decision block 24 to measure the timing error for another one second time period, thereby constantly updating the value of the parameter TIMER ERROR. Meanwhile, the value of the parameter TIMER ERROR is stored, and during an AC power failure, is summed with the number of RC timing pulses 14 received each second in an RC timing pulse calibration 42, to derive a calibrated time base 44, accurate to approximately ±2%.

Several examples will illustrate this calibration process.

EXAMPLE 1

If the RC timing pulse 14 is received at precisely the frequency of 61 Hz, at a time interval of 16.393 milliseconds, the parameter TEMP ERROR will be sequentially decremented and incremented by one until an error between the RC timing pulses 14 and the 60 Hz timing pulses, at a time interval of 16.667 milliseconds, has accumulated the full RC timing pulse 14 interval of 16.393 milliseconds. This will occur at the 60th 60 Hz timing pulse.

no. of 60 Hz timing pulses × (16.667–16.393) = 16.393 no. of 60 Hz timing pulses = 16.393/0.274 no. of 60 Hz timing pulses ≈ 60.

Therefore, when the value of the parameter SUBSEC TIMER becomes equal to or greater than sixty, the value of the parameter TEMP ERROR will be a negative one. The value of the parameter TIMER ERROR will be set to a negative one, which will be summed with the 61 Hz RC timing pulse 14 to derive the calibrated time base 44 at 60 Hz (61. − 1. = 60 Hz).

EXAMPLE 2

If the RC timing pulse is received at a frequency of 79.3 Hz (30% higher than the 61 Hz), at a time interval of 12.61 milliseconds, the parameter TEMP ERROR will be sequentially decremented and incremented by one until an error between the RC timing pulses 14 and the 60 Hz timing pulses has accumulated the full RC timing pulse 14 interval of 12.61 milliseconds. This will occur every 3.11 60 Hz timing pulses.

no. of 60 Hz timing pulses × (16.667–12.61) = 12.61 no. of 60 Hz timing pulses = 12.61/4.057 no. of 60 Hz timing pulses ≈ 3.11

Therefore, when the value of the parameter SUBSEC TIMER becomes equal to or greater than sixty, the value of the parameter TEMP ERROR will be −19 (60/3.11 ≈ 19). The value of the parameter TIMER ERROR will be set to −19, which will be summed with the 79.3 Hz RC timing pulse 14 to derive the calibrated time base 44 at 60.3 Hz (79.3–19 = 60.3 Hz).

Figure 2:
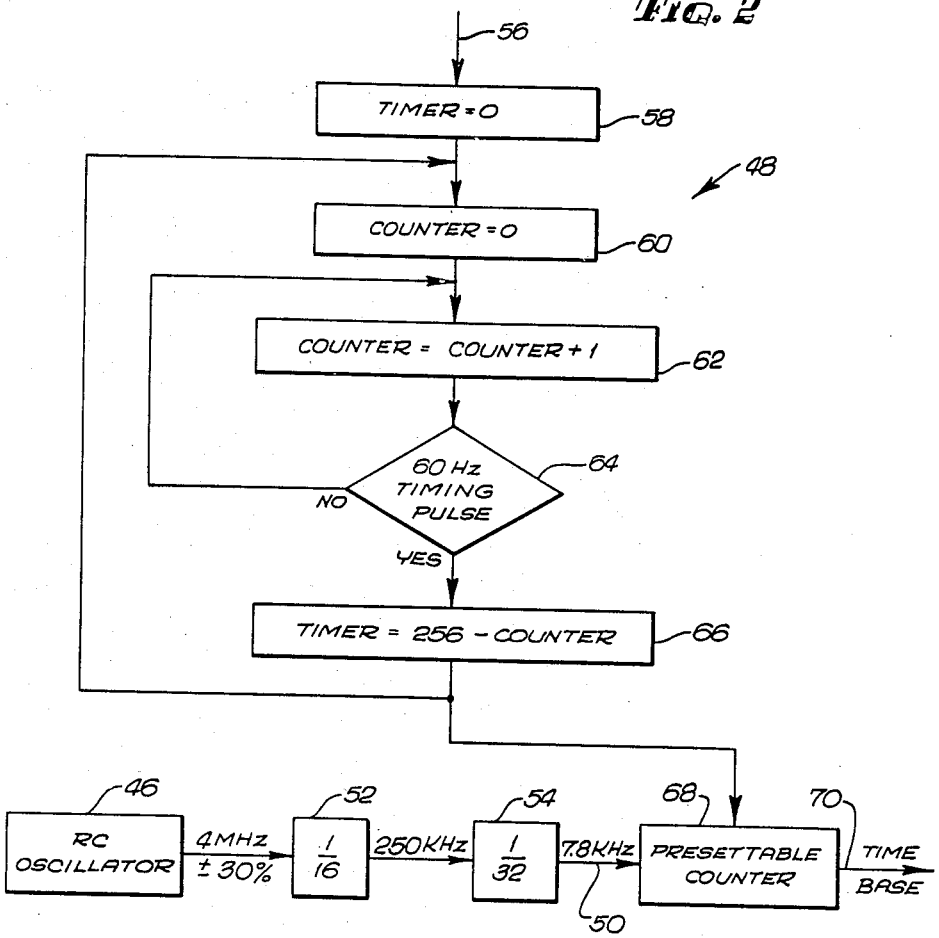
FIG. 2 is a schematic diagram of a calibrated RC timing source and a flow chart of the calibrating instructions.

As shown in FIG. 2, another presently preferred embodiment of the invention includes an inexpensive RC oscillator 46 and a set of simple algebraic and logic instructions, represented by a flow chart 48, capable of being implemented in any suitable microprocessor. The RC oscillator 46 includes any resistive and capacitive elements capable of generating a sinusoidal oscillation at a frequency of approximately 4 MHz, with an accuracy on the order of ±30%. The 4 MHz oscillation is converted into a digital RC timing pulse 50, with a frequency of approximately 7.8 KHz, by a 1/16 divider 52 and a 1/32 divider 54.

In the presently preferred embodiment of the invention, the set of algebraic and logic instructions, represented by the flow chart 48 in FIG. 2, is implemented in an 8048-type microprocessor. The set of instructions generates a timing error between the RC timing pulse 50 and a 60 Hz timing pulse derived from an ac power line. The timing error is then used to calibrate the RC oscillator 46, during battery operation, to an accuracy of approximately ±1%.

More specifically, as shown by the flow chart 48, a parameter COUNTER counts the number of RC timing pulses 50 received by the microprocessor while waiting for the 60 Hz timing pulse. The flow chart 48 is entered at a point 56 and a parameter TIMER is initialized to zero in block 58. The parameter COUNTER is initialized to zero in block 60. The parameter COUNTER is then incremented by one in block 62 at the RC timing pulse 50 frequency of approximately 7.8 KHz, at a time interval of approximately 0.128 milliseconds, until the 60 Hz timing pulse is received. The 60 Hz timing pulse is received at decision block 64, at a time interval of approximately 16.667 milliseconds. When the 60 Hz timing pulse is received at the decision block 64, block 66 is executed, which sets the value of the parameter TIMER equal to 256 minus the value of the parameter COUNTER. The flow chart 48 then returns to block 60, to measure the timing error for another approximately 16.667 millisecond time period, thereby constantly updating the value of the parameter TIMER. Meanwhile, the value of the parameter TIMER is stored, and during an ac power failure, is used to preset a binary counter 68, which is driven by the RC timing pulse 50. The binary counter 68 overflows at a value of 256. The time interval between overflows of the binary counter 68 is a calibrated time base 70, accurate to approximately ±1%.

Several examples will illustrate this calibration process.

EXAMPLE 1

If the RC timing pulse 50 is received at precisely the frequency of 7.8 KHz, at a time interval of 0.128 milliseconds, the parameter COUNTER will count to 130 between the 60 Hz timing pulses, which occur every 16.667 milliseconds (0.128 milliseconds×130≈16.667 milliseconds). The value of the parameter TIMER will then be 126, which will be used to preset the binary counter 68. The binary counter 68 will be driven by the RC timing pulse 50 at a frequency of 7.8 KHz, and will overflow the binary counter 68 after 130 pulses, or 16.667 milliseconds, thereby generating the calibrated time base 70.

EXAMPLE 2

If the RC timing pulse 50 is received at a frequency of 10.16 KHz (30% higher than 7.8 KHz), at a time interval of 0.0985 milliseconds, the parameter COUNTER will count up to 169 between the 60 Hz timing pulses (0.0985 milliseconds×168≈16.667 milliseconds). The value of the parameter TIMER will then be 87, which will be used to preset the binary counter 68. The binary counter 68 will be driven by the RC timing pulse 50 at a frequency of 10.16 KHz, and will overflow the binary counter 68 after 169 pulses, or 16.667 milliseconds.

Figure 3:
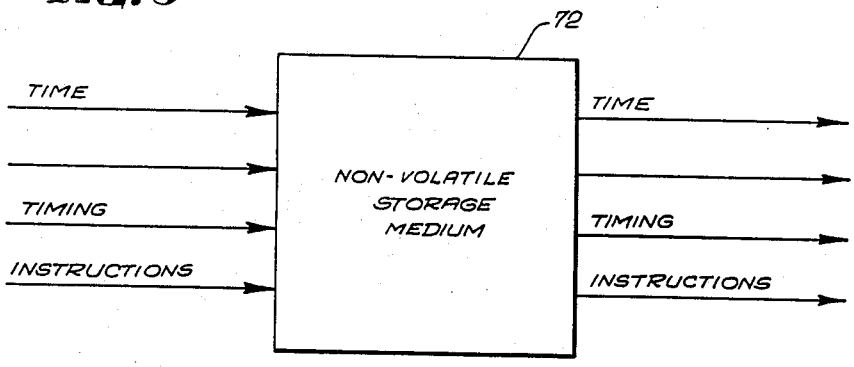
FIG. 3 is a schematic diagram of a non-volatile storage medium.

As shown in FIG. 3, the presently preferred embodiments of the invention may also include a non-volatile storage medium 72. The storage medium 72 is used to store the time of day, including the seconds, minutes, hours, day, month and year, and a set of timing instructions, including any number of on/off times. In this manner, the time of day and the timing instructions will be preserved in the event that the battery becomes drained, and will not reset to default values or to random values when the power is restored. The electronic clock will consequently behave in an analogous fashion to that of an electromechanical clock, that is, the "dial," or clock information will freeze at the time the power failure occurs, and will continue from that point when the power is restored. However, considering that most power failures are of a short duration, the electronic time will be off by only a few minutes, rather than having a completely erroneous reading.

Typical examples of the non-volatile storage medium 72 are a magnetic-bubble memory system manufactured by Bubbl-tec in Dublin, Calif. and an MK 48Z02 random access memory manufactured by Mostek, a division of United Technologies, in Carrollton, Tex.

From the foregoing, it will be appreciated that the apparatus and method of the present invention provides an inexpensive and accurate auxiliary timing source for electronic clocks to be used during power failures. Although several embodiments of the invention have been shown and described, it will be appreciated that other adaptations and modifications can be made without departing from the true spirit and scope of the invention.

I claim:

1. An auxiliary timing source for electronic clocks powered by an alternating current (ac), comprising:

a resistor-capacitor (RC) oscillator; and means for calibrating the RC oscillator continuously with a frequency of the alternating current until loss of the ac power.

2. The auxiliary timing source of claim 1, wherein the means for calibrating includes:

means for converting a frequency of the RC oscillator into an RC digital timing pulse;

means for converting a frequency of the ac power into an ac digital timing pulse;

means for computing a timing error between the RC digital timing pulse and the ac digital timing pulse; and means for correcting the RC digital timing pulse with the timing error.

3. The auxiliary timing source of claim 2, wherein the means for computing a timing error includes:

means for counting the difference between the number of RC digital timing pulses and the number of ac digital timing pulses over a one second time interval, the difference between the number of timing pulses being the timing error.

4. The auxiliary timing source of claim 3, wherein the means for correcting the RC digital timing pulse includes:

means for summing the timing error with the number of RC digital timing pulses counted during the one second time interval, the sum being the output of the auxiliary timing source.

5. The auxiliary timing source of claim 2, wherein the means for computing a timing error includes:

means for counting the number of RC digital timing pulses during an interval between ac digital timing pulses, the number of RC digital timing pulses being the timing error.

6. The auxiliary timing source of claim 5, wherein the means for correcting the RC digital timing pulse includes:

a binary counter presettable with the timing error, the time interval between overflows of the binary counter being the output of the auxiliary timing source.

7. The auxiliary timing source of claim 1, and further comprising:

a non-volatile storage medium for storing the time of day and a set of timing instructions, thereby preserving the time of day and the timing instructions in the event of a drained battery.

8. A method for providing an auxiliary timing source for electronic clocks powered by an alternating current (ac), comprising the steps of:

calibrating a resistor-capacitor (RC) oscillator continuously with a frequency of the alternating current until loss of the ac power; and utilizing the calibrated RC oscillator as the auxiliary timing source during loss of the ac power.

9. The method of claim 8, wherein the step of calibrating the RC oscillator includes:

converting a frequency of the RC oscillator into an RC digital timing pulse;

converting a frequency of the ac power into an ac digital timing pulse;

computing a timing error between the RC digital timing pulse and the ac digital timing pulse; and correcting the RC digital timing pulse with the timing error.

10. The method of claim 9, wherein the step of computing a timing error includes:

counting the difference between the number of RC digital timing pulses and the number of ac digital timing pulses over a one second time interval, the difference between the number of timing pulses being the timing error.

11. The method of claim 10, wherein the step of correcting the RC digital timing pulse includes:

summing the timing error with the number of RC digital timing pulses counted during the one second time interval, the sum being the output of the auxiliary timing source.

12. The method of claim 9, wherein the step of computing a timing error includes:

counting the number of RC digital timing pulses during an interval between ac digital timing pulses, the number of RC digital timing pulses being the timing error.

13. The method of claim 12, wherein the step of correcting the RC digital timing pulse includes:

presetting a binary counter with the timing error, the time interval between overflows of the binary counter being the output of the axuiliary timing source.

14. The method of claim 8, and further comprising:

storing the time of day and a set of timing instructions in a non-volatile storage medium, thereby preserving the time of day and the timing instructions in the event that the battery becomes drained.

* * * * *